US006239652B1

(12) United States Patent
Oh et al.

(10) Patent No.: US 6,239,652 B1
(45) Date of Patent: May 29, 2001

(54) INTERNAL VOLTAGE FALL-DOWN CIRCUIT

(75) Inventors: Young Nam Oh; Jung Seop Lee, both of Kyungki-Do (KR)

(73) Assignee: Hyundai Electronics Co., Ltd., Ichon-shi (KR)

( * ) Notice: Subject to any disclaimer, the term of this patent is extended or adjusted under 35 U.S.C. 154(b) by 0 days.

(21) Appl. No.: 09/340,688

(22) Filed: Jun. 29, 1999

(30) Foreign Application Priority Data

Jun. 29, 1998 (KR) ..... 98-24832

(51) Int. Cl.[7] ..... G05F 1/10
(52) U.S. Cl. ..... 327/541; 323/316
(58) Field of Search ..... 327/540, 541, 327/543; 323/316

(56) References Cited

U.S. PATENT DOCUMENTS 5,254,883 * 10/1993 Horowitz et al. ..... 327/541
5,335,203 * 8/1994 Ishii et al. ..... 327/541
5,467,052 * 11/1995 Tsukada ..... 327/543
5,485,117 * 1/1996 Furumochi ..... 327/543
5,506,541 * 4/1996 Herndon ..... 327/541
5,661,683 8/1997 Song ..... 365/230.06
5,689,460 11/1997 Ooishi ..... 327/535
5,875,145 2/1999 Yamasaki et al. ..... 365/226

FOREIGN PATENT DOCUMENTS 62-165962 7/1987 (JP) .

* cited by examiner

*Primary Examiner*—Terry D. Cunningham
(74) *Attorney, Agent, or Firm*—Pennie & Edmonds LLP

(57) ABSTRACT

An internal voltage fall-down circuit includes a reference voltage generating section for variably generating an optimum reference voltage level of which is compensated for depending on changes in the present reference voltage before fuse blowing, a reference voltage transforming section for receiving the reference voltage from the reference voltage generating section and then transforming the reference voltage into voltage for a normal mode or a stress mode which are presently set, and a driver section for providing a signal from the reference voltage transforming section to an internal circuit as an internal supply voltage.

11 Claims, 4 Drawing Sheets

INTERNAL VOLTAGE FALL-DOWN CIRCUIT

BACKGROUND OF THE INVENTION

1. Field of the Invention

The present invention relates to an internal voltage fall-down circuit of a semiconductor device. In particular, the present invention relates to an internal voltage fall-down circuit which can test fuse programs for controlling an internal power supply voltage by pad signals without fuse blowing.

2. Description of the Prior Art

A conventional internal voltage fall-down circuit includes a reference voltage generating section 10, a reference voltage transforming section 20 and a driver section 30, as shown in FIG. 1, wherein an output signal Vint from the conventional internal voltage fall-down circuit is input to an internal circuit 40 as supply voltage. An output signal VR2 from the reference voltage generating section 10 is input to a first input terminal of a first comparator 21 in the reference voltage transforming section 20, and an output signal VR from the reference voltage transforming section 20 is used as a final comparison voltage of the driver section 30.

A reference voltage generator 11 in the reference voltage generating section 10 outputs a stabilized voltage VR1 regardless of external voltage fluctuations. Common types of it are a bandgap reference voltage generator or Windler current source. The output voltage VR1 from the reference voltage generator 11 is input to the first input terminal of the first comparator 12 in the voltage amplifier 16. Then an output voltage VR2 from the reference voltage generator 16 is divided into a given voltage Va by a voltage divider consisted of fixed resistors 14, 15, which is then input to the second input terminal of the first comparator 12. A fallen reference voltage VR2 is then output from a first current driver 13 connected to the output terminal of the first comparator 12.

The resistor 15 is a fixed resistor to provide a single resistance value corresponding to fuse programs.

The reference voltage transforming section 20 performs a normal mode and a stress mode operation and then outputs an output voltage in a normal mode operation, wherein the reference voltage VR2 from the reference voltage generating section 10 is input to the first input terminal of a second comparator 21 used in a normal mode operation, the output voltage VR is feedbacked to the second input terminal of the second comparator 21 thereof, and the second current driver 22 is connected to the output terminal of the second comparator 21 thereof.

The reference voltage transforming section 20 outputs the output voltage VR in a stress mode operation, wherein a bias voltage VST from a bias circuit 23 is input to the first input terminal of a third comparator 24 used in a stress mode operation, the output voltage VR is feedbacked to the second input terminal of the third comparator 24 thereof and a third current driver 25 is connected to the output terminal of the third comparator 24 thereof.

Here, the term "a normal mode operation" means that "supply voltage=3.3V±10% and the term "a stress mode operation" means that "supply voltage is more than 1.5× 3.3V".

In addition, in a normal mode operation, since the second current driver 22 is enabled by the second comparator 21 and the third current driver 25 is enabled by the third comparator 24, the resulting output voltage VR holds the reference voltage VR2 from the reference voltage generating section 10. In a stress mode operation, since the second current driver 22 is enabled by the second comparator 21 and the third current driver 25 is enabled by the third comparator 24, the resulting output voltage VR holds the bias voltage VST from the bias circuit 23. Meanwhile, as the node onto which the bias voltage will be carried is connected to the bias circuit 23 and the fall-down current sink 27, the bias voltage VST keeps "supply voltage-nVt(n=2)".

The driver section 30 is used to provide current corresponding to each state of operation in the internal circuit 40. However, when the supply voltage is turned on, the driver section 30 may be consisted of standby drivers 31, 32 and 35, and activation drivers 33, 34 which are activated by an enable clock ACT only during an active mode. The standby drivers 31, 32 and 35 has a structure of voltage follower type, in which the fall-down current sink 35 is connected to the node for outputting the internal supply voltage Vint from the internal circuit 40 and a ground voltage terminal. The activation drivers 33, 34 are also voltage follower types.

The internal circuit 40 may be an on-chip circuit which employs the internal supply voltage Vint, a given value of which is fallen down, from an external supply voltage.

Normally, in the above-mentioned internal voltage fall-down circuit, variations in processes or noises occurring during operation of the on-chip circuit may cause the internal supply voltage levels to fluctuate. Accordingly, in order to compensate for the fluctuations in the internal supply voltage level, it is preferred that the above reference voltage VR2 is controlled using a fuse program, when the reference voltage of the comparator for driving the final current driver.

Here, the variations in processes mean threshold voltage Vt or saturation current Ids. The noises occurring during operation of the on-chip circuit mean current spikes which cause a large current flow at a sensing or an input/output circuit, noise of which affects the internal circuit to cause change of preset voltage (i.e., change in potentials of the reference voltage).

Accordingly, the above-mentioned conventional internal voltage fall-down circuit has problems that it could compensate for the level changes in or test the reference voltage VR2 from the reference voltage generating section 10, and could measure information for fuse blowing, only after programming of the fuses built in the resistor 15 of the reference voltage generating section 10 is performed.

SUMMARY OF THE INVENTION

It is an object of the present invention to solve the problems involved in the prior art, and to provide an internal voltage fall-down circuit which is capable of previously measuring the potential of an internal supply voltage being the final output by changing a previously fuse-programmed reference voltage before the fuse blowing, and then of providing a fuse blowing information, when performing a fuse programming to set the potential of the optimum internal supply voltage.

To achieve the above object, the internal voltage fall-down circuit according to a preferred embodiment of the present invention is characterized by comprising:

a reference voltage generating section for variably generating an optimum reference voltage level of which is compensated for depending on changes in the preset reference voltage before fuse blowing;

a reference voltage transforming section for receiving the reference voltage from the reference voltage generating section and transforming the reference voltage into voltage for a normal mode or a stress mode which are presently set; and a driver section for providing the signal from the reference voltage transforming section to an internal circuit as an internal supply voltage.

BRIEF DESCRIPTION OF THE DRAWINGS

The above object, and other features and advantages of the present invention will become more apparent by describing the preferred embodiment thereof with reference to the accompanying drawings, in which.

DETAILED DESCRIPTION OF PREFERRED EMBODIMENT

Figure 1:
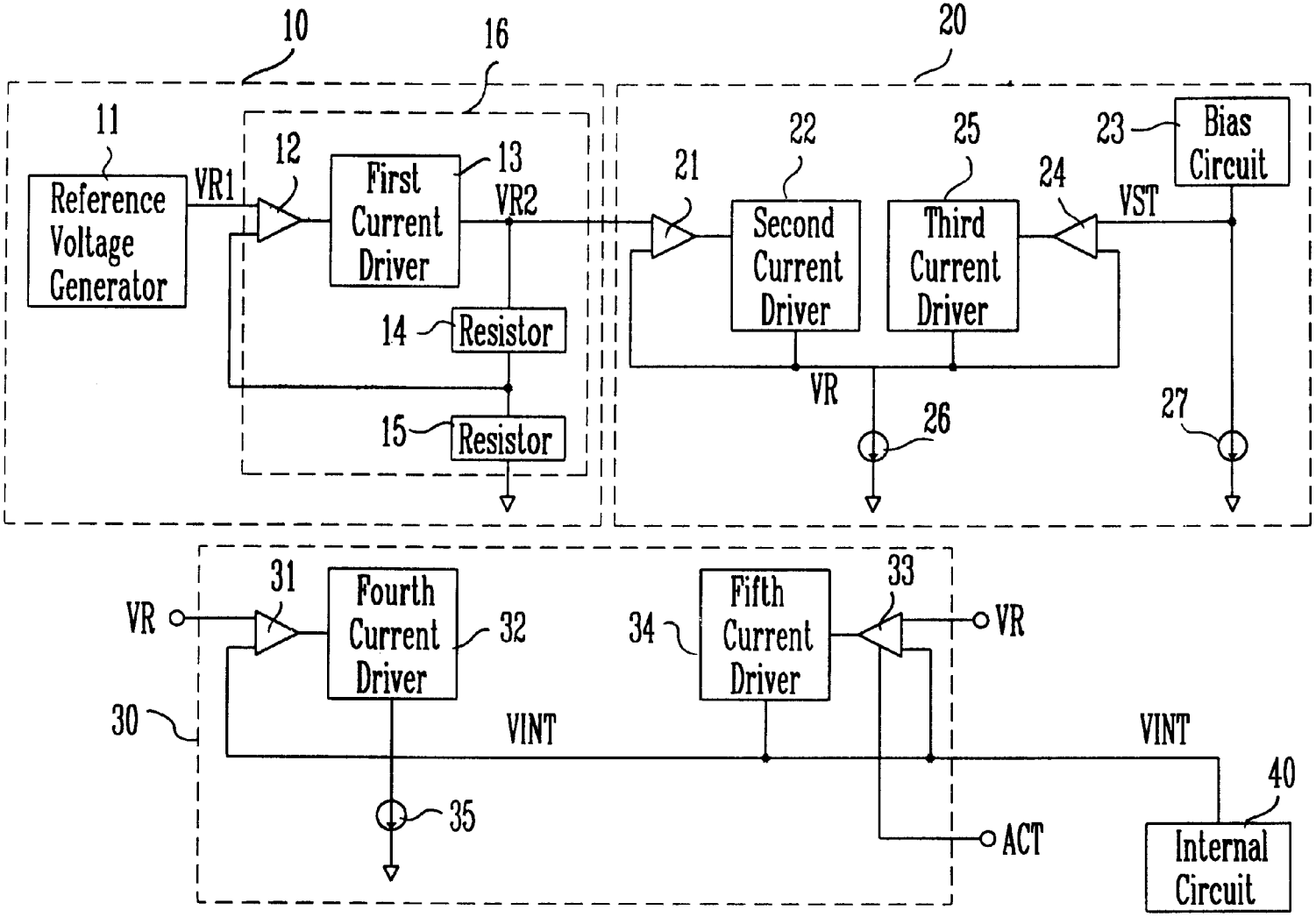
FIG. 1 (PRIOR ART)
FIG. 1 is a block diagram for illustrating a conventional internal voltage fall-down circuit.
Figure 2:
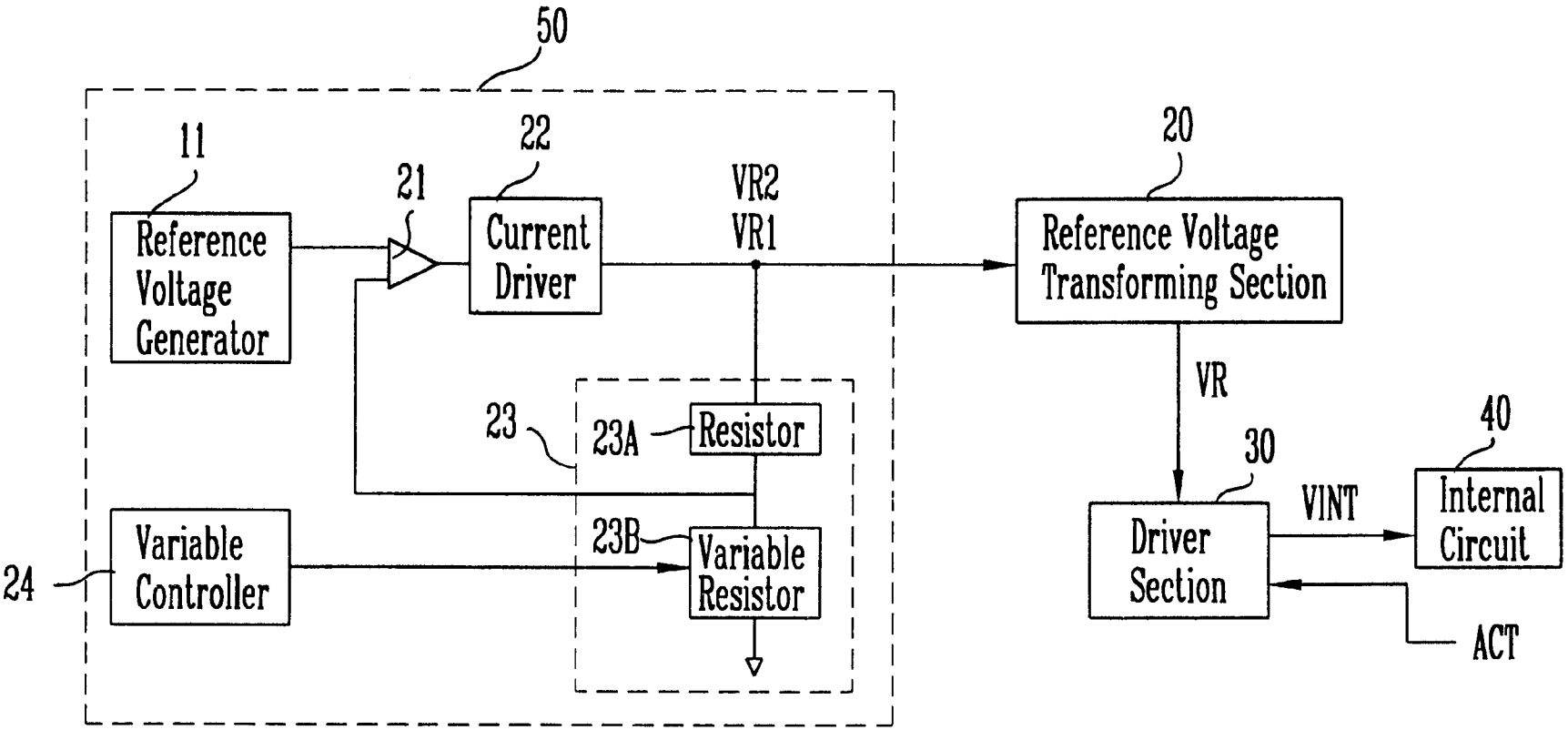
FIG. 2 is a block diagram for illustrating an internal voltage fall-down circuit according to an embodiment of the present invention.

FIG. 2 is a block diagram for illustrating the internal voltage fall-down circuit according to one embodiment of the present invention, in which the same components to those described with respect to FIG. 1 will be designated to same reference numerals.

The internal voltage fall-down circuit according to one embodiment of the present invention includes a reference voltage generating section 50 for variably generating an optimum reference voltage, the level of which is compensated for depending on changes in the preset reference voltage VR2 before fuse blowing; a reference voltage transforming section 20 for receiving the reference voltage VR2 from the reference voltage generating section 50, transforming the reference voltage VR2 into voltage for a normal mode when the operation mode internally set is set to the normal mode, and transforming the reference voltage VR2 into voltage for a stress mode when it is set to the stress mode; and a driver section 30 for providing the signal from the reference voltage transforming section 20 to an internal circuit 40 as an internal supply voltage Vint.

Here, the reference voltage generating section 50 includes a reference voltage generator 11 for generating a first constant reference voltage VR1; a comparator 21 for comparing a final preset reference voltage feedbackedly received at its first input terminal with the first reference voltage VR1 from the reference generator 11; a current driver 22 for providing a given final reference voltage VR2 to the reference voltage transforming section 20 in response to the comparison result at the comparator 21; a voltage regulator 23 for variably regulating the final reference voltage VR2 feedbacked to the second input terminal of the comparator 21, which includes a fixed resistor element 23A and a variable resistor element 23B both serially connected between the output terminal of the current driver 22 and the ground; and a variable controller 24 for variably changing the resistance value at the variable resistor element 23B of the voltage regulator 23 to control a variable regulating operation by the voltage regulator 23.

The final reference voltage VR2 output from the reference voltage generating section 50 may be obtained by the following Equation 1:

Equation 1

$$V_{VR2}=V_{VR1}(1+Rr2/Rr1)$$

In equation 1, it can be seen that $V_{VR2}$ is proportional to the resistance value of Rr2 if the value of Rr1 is fixed. The control signal output from the variable controller 24 is used to change the resistance value of Rr2.

Accordingly, in the reference voltage generating section 50, the first reference voltage VR1 from the reference voltage generator 11 is applied to the first input terminal of the comparator 21, and at the same time the variable controller 24 controls the voltage regulator 23 to variably regulate change of the preset reference voltage VR2 by the amount of change, so that the regulated amount of change can be input to the second input terminal of the comparator 21. Then the comparator 21 compares the two input signals from the two input terminals and then provides the reference voltage transforming section 20 with an optimum reference voltage VR2 the level of which has been compensated for by the current driver 22.

Figure 3:
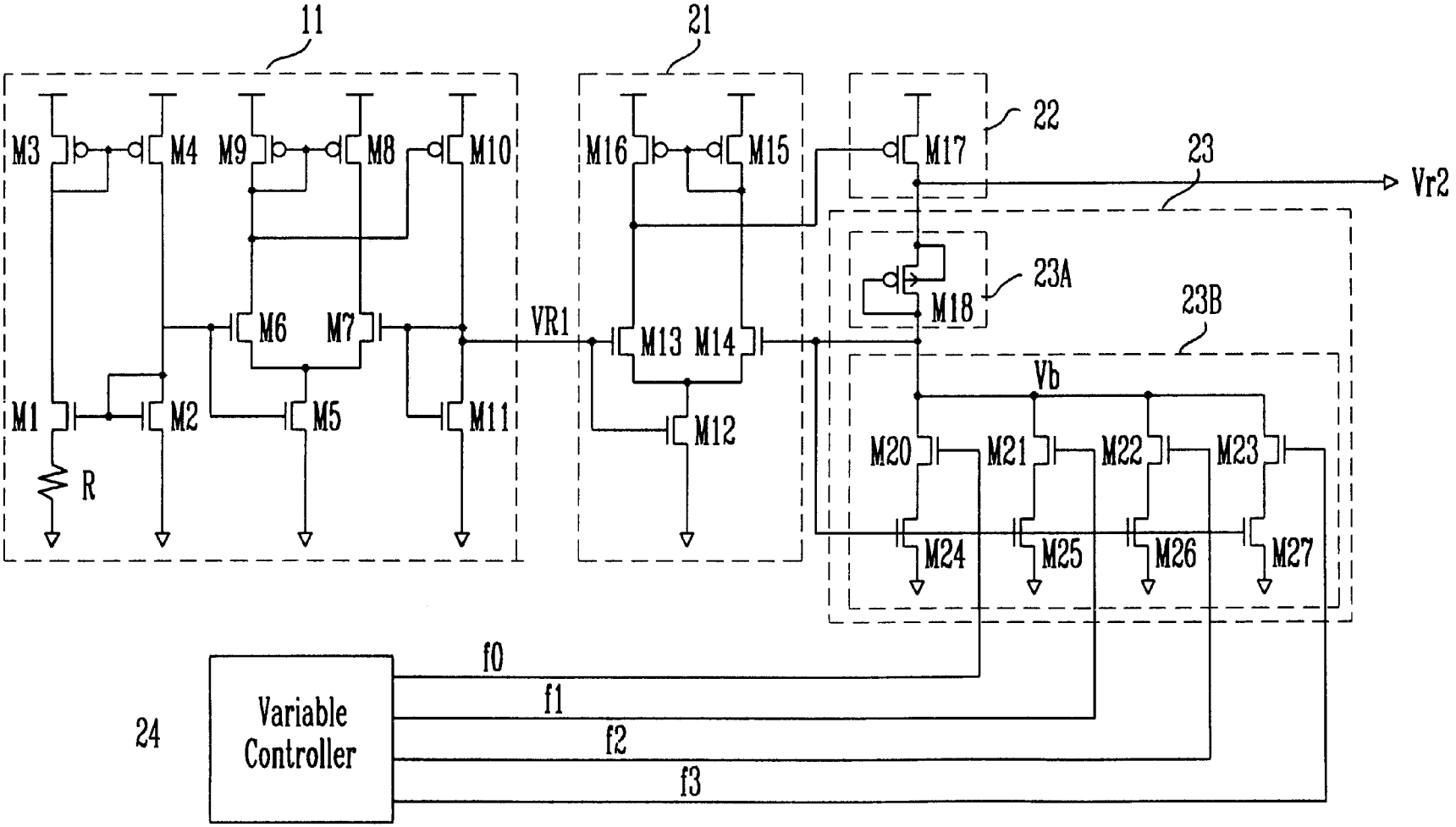
FIG. 3 shows an internal circuit diagram of a reference voltage generating section shown in FIG. 1.

Referring to FIG. 3, there is shown in detail the reference voltage generating section 50 among the constitutional components of the present invention.

The resistor R and the MOS transistors M1–M4 are common Windler current sources to provide a constant-voltage source VR0, and the resulting output voltage can be expressed as follows:

Equation 2

$$V_{VR0}=Vvt(M1)+2/R\beta_2(1-1/K)$$

Wherein, $K=\sqrt{\beta 1/\beta 2}$, β1 and β2 are the values of the MOS transistors M1 and M2.

In equation 2, it can be seen that the potential of VR0 will provide a constant voltage if the threshold voltage of the MOS transistor M1 and the value of the resistor R are a constant value.

The MOS transistors M5 to M11 are voltage followers, resultingly $V_{VR0}=V_{VR1}$.

The MOS transistors M12 to M16 correspond to the comparator 21 in FIG. 2 and the PMOS transistor M17 also corresponds to the current driver 22 in FIG. 2. The diode connection-type PMOS transistor M18 determines the value of Rr1 (see Equation 1) to be effective when operating as the fixed resistor element 23A in FIG. 2 and the NMOS transistors M20 to M27 also determine the value of Rr2 (see Equation 1) to be effective when operating as the variable resistor element 23B in FIG. 2.

The gates of the NMOS transistors M20 to M23 in the variable resistor 23B receive the control signals f0 to f3 from the variable controller 24, respectively, and also the gates of the NMOS transistors M24 to M27 thereof is connected to the second input terminal of the comparator 21 (i. e, the gate of the NMOS transistor M14), wherein the channel sizes of each of the NMOS transistors M24 to M27 are differential among another.

At this time, only any one of the control signals f0 to f3 from the variable controller 24 may be at a logic high and the remaining control signals may be at a logic low. For example, if the control signal f3 is at a logic high and the remaining control signals f0 and f2 are a logic low, the NMOS transistors M23 and M27 are turned on to determine the effective value of the Rr2 and the remaining NMOS transistors M20, and M22 are turned off to separate it from the node vb.

Accordingly, since the channel sizes of each of the NMOS transistors M20 to M23 in the variable resistor element 23B are differential among another, and only any one of the control signals f0 to f3 output from the variable controller 24 is at a logic high, the resistance value of the resistor element 23B is determined by means of the selected MOS transistor, so that a variable voltage Va will be applied to the second input terminal of the comparator 21 apart from a prior art.

Figure 4:
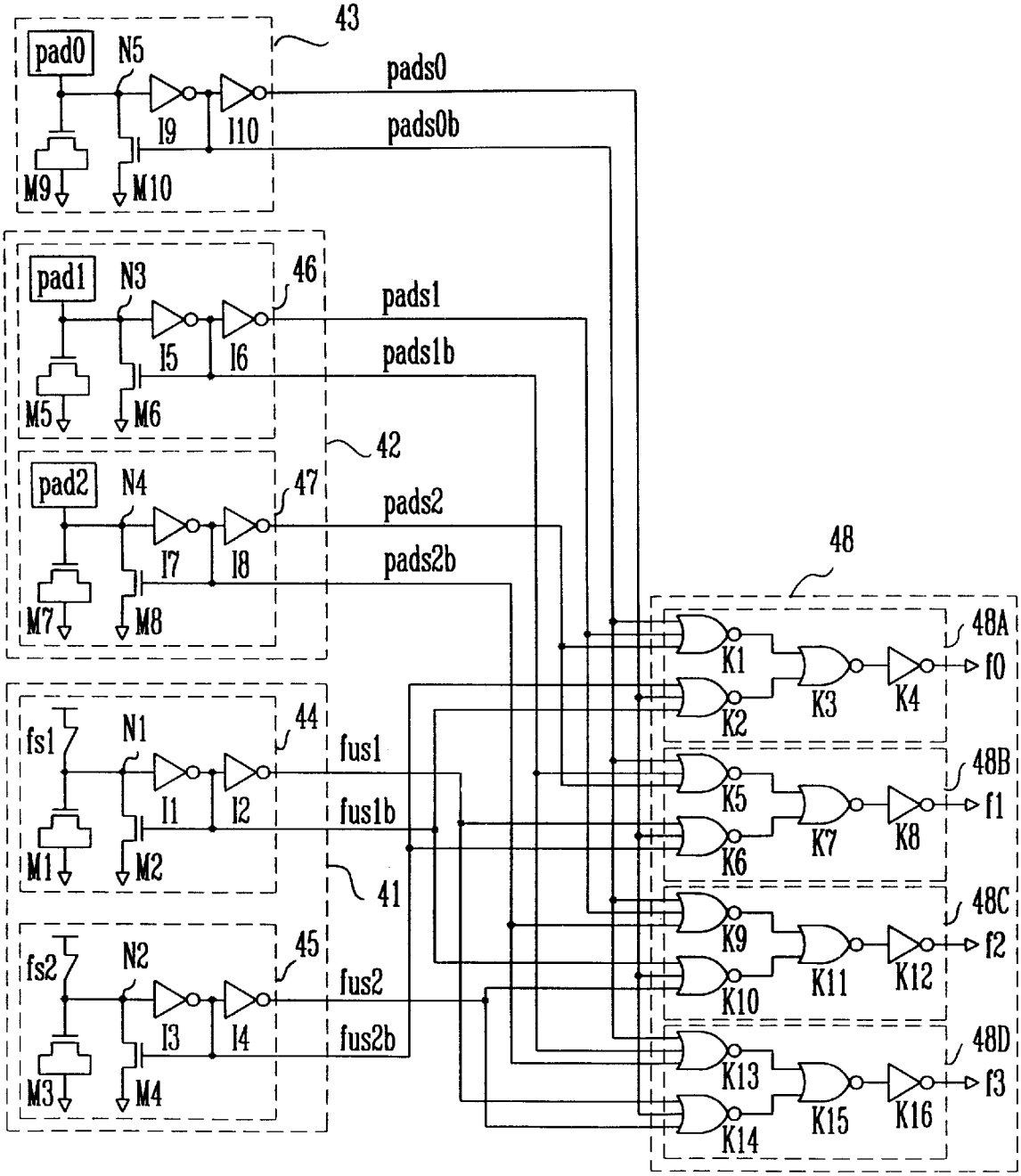
FIG. 4 shows an internal circuit diagram of a mode decoder shown in FIG. 1.

Referring now to FIG. 4, there is shown in detail the variable controller 24 in FIG. 3. The variable controller 24 includes a fuse detecting section 41 for detecting a plurality of fuse signals fus1, fus1*b;* fus2, fus2*b;* a pad signal detecting section 42 for detecting a plurality of pad signals pads1, pads1*b;* pads2, pads2*b;* a selecting section 43 for selecting any one of the fuse signal detecting section 41 and the pad signal detecting section 42; and a control signal output section 48 for combining the signals from the fuse signal detecting section 41 and the pad signal detecting section 42 so as to output the control signals f0 to f3 for the voltage regulator 23.

The fuse signal detecting section 41 includes a first fuse signal detecting section 44 for outputting first fuse signals fus1, fus1*b;* and a second fuse signal detecting section 45 for outputting second fuse signals fus2, fus2*b*. The first fuse signal detecting section 44 includes a fuse fs1 connected to the power supply; a MOS capacitor M1 and NMOS transistor M2 both connected between the fuse fs1 and the ground, for maintaining a given level of signal depending on whether the fuse is blown or not; and inverters I1,I2 both serially connected to the node N1 between the fuse fs1 and the MOS capacitor M1, for performing a delay operation against the signal of the node N1. to output the first fuse signals fus1, fus1*b*. The output terminal of the inverter I1 is connected to the gate of the NMOS transistor M2 and at the same time it becomes the output terminal to output the inverted signal fus1*b* of the first fuse signals.

In the first fuse signal detecting section 44, if the fuse fs1 is blown, the node N1 turns to be a logic low, so that the fuse signal fus1 of logic low and the fuse signal fus1*b* of logic high are output therefrom. However, if the fuse fs1 is not blown, the node N1 turns to be a logic high, so that the fuse signal fus1 of logic high and the fuse signal fus1*b* of logic low are output therefrom.

The second fuse signal detecting section 45 has the same construction as the first fuse signal detecting section 44 and also performs a same operation as the first fuse signal detecting section 44.

The pad signal detecting section 42 includes a first pad signal detecting section 46 for detecting first pad signals pads1, pads1*b;* and a second pad signal detecting section 47 for detecting second pad signals pads2, pads2*b*. The first pad signal detecting section 46 includes a MOS capacitor M5 and a NMOS transistor M6 connected between the pad pad1 and the ground, for maintaining a given level of signal depending on whether the supply voltage is applied to the pad pad1 or not; and inverters I5, I6 both serially connected to the node N3 between the pad pad1 and the MOS capacitor M5, for performing a delay operation against the signal of the node N3 to output the first pad signals pads1, pads1*b*. The output terminal of the inverter I5 is connected to the gate of the NMOS transistor M6 and at the same time it becomes the output terminal to output the inverted signal pads1*b* of the first pad signals.

In the first pad signal detecting section 46, if an external supply voltage is applied to the pad pad1, the node N3 turns to be a logic high, so that the pad signals pads1 of logic high and the pad signal pads1*b* of logic low are output therefrom. However, if no external supply voltage is applied to it, the node N3 turns to be a logic low, so that the pad signal pads1 of logic low and the pad signal pad1*b* of logic high are output therefrom.

The second pad signal detecting section 47 has also the same construction as the first pad signal detecting section 46 and also performs a same operation as the first pad signal detecting section 46.

The selecting section 43 includes a MOS capacitor M9 and a NMOS transistor M10 both connected between the pad pad0 and the ground, for maintaining a given level of signal depending on whether the supply voltage is applied to the pad pad0 or not; and inverters I9,I10 both serially connected to the node N5 between the pad pad0 and the MOS capacitor M9, for performing a delay operation against the signal of the node N5 to output the select signals pads0, pads0*b*. The output terminal of the inverter 19 is connected to the gate of the NMOS transistor M10 and at the same time it becomes the output terminal to output the inverted signal pads0*b* of the select signals.

The selecting section 43 outputs the potential signal of the pad pad0 as the select signal pads0 and also outputs the inverted signal thereof as the select signal pads0*b*. For example, if the signal of the pad pad0 is a logic low, as the select signal pads0 becomes a logic low, the selecting section 43 may transmit the signals detected at the fuse signal detecting section 41 to the final outputs f0 to f3. However, as the select signal pads0*b* becomes a logic high, the selecting section 43 cannot transmit the signals detected at the pad signal detecting section 42 to the final outputs f0 to t3.

On the contrary, if the signal of the pad pad0 is a logic high, as the select signal pads0*b* becomes a logic high, the selecting section 43 cannot transmit the signals detected at the fuse signal detecting section 41 to the final outputs f0 to f3. However, as the select signal pads0*b* is a logic low, the selecting section 43 may transmit the signals detected at the pad signal detecting section 42 to the final outputs f0 to f3.

The control signal output section 48 includes control signal output sections 48A to 48D. The first control signal output section 48A includes a NOR gate K1 for NORing the select signal pads0*b* from the selecting section 43, the detection signal pads1 from the first pad signal detecting section 46 and the detection signal pads2 from the second pad signal detecting section 47 using them as inputs; a NOR gate K2 for NORing the select signal pads0 from the selecting section 43, the detection signal fus1*b* from the first fuse signal detecting section 44 and the detection signal fus2*b* from the second fuse signal detecting section 45 using them as inputs; a NOR gate K3 for NORing the output signals from the NOR gates K1,K2 using them as inputs; and an inverter K4 for inverting the output signal from the NOR gate K3 to output a first control signal f0 for controlling the NMOS transistor M20 of the variable resistor element 23B to switch.

The second control signal output section 48B includes a NOR gate K5 for NORing the select signal pads0*b* from the selecting section 43, the detection signal pads1*b* from the first pad signal detecting section 46 and the detection signal pads2 from the second pad signal detecting section 47 using them as inputs; a NOR gate K6 for NORing the select signal pads0 from the selecting section 43, the detection signal fus1 from the first fuse signal detecting section 44 and the detection signal fus2*b* from the second fuse signal detecting section 45 using them as inputs; a NOR gate K7 for NORing the output signals from the NOR gates K5,K6 using them as inputs; and an inverter K8 for inverting the output signal from the NOR gate K7 to output a second control signal f1 for controlling the NMOS transistor M21 of the variable resistor element 23B to switch.

The third control signal output section 48C includes a NOR gate K9 for NORing the select signal pads0*b* from the selecting section 43, the detection signal pads1 from the first pad signal detecting section 46 and the detection signal pads2*b* from the second pad signal detecting section 47 using them as inputs; a NOR gate K10 for NORing the select signal pads0 from the selecting section 43, the detection signal fus1*b* from the first fuse signal detecting section 44 and the detection signal fus2 from the second fuse signal detecting section 45 using them as inputs; a NOR gate K11 for NORing the output signals from the NOR gates K9,K10 using them as inputs; and an inverter K12 for inverting the output signal from the NOR gate K11 to output a third control signal f2 for controlling the NMOS transistor M22 of the variable resistor element 23B to switch.

The fourth control signal output section 48D includes a NOR gate K13 for NORing the select signal pads0*b* from the selecting section 43, the detection signal pads1*b* from the first pad signal detecting section 46 and the detection signal pads2*b* from the second pad signal detecting section 47 using them as inputs; a NOR gate K14 for NORing the select signal pads0 from the selecting section 43, the detection signal fus1 from the first fuse signal detecting section 44 and the detection signal fus2 from the second fuse signal detecting section 45 using them as inputs; a NOR gate K15 for NORing the output signals from the NOR gates K13, K14 using them as inputs; and an inverter K16 for inverting the output signal from the NOR gate K15 to output a fourth control signal f4 for controlling the NMOS transistor M23 of the variable resistor element 23B to switch.

Though the above embodiment of the present invention uses a fuse of two bits and a pad signal of two bits to produce four control signals f0 to f3, the number of bits of the fuse signal and the pad signal can be increased to increase the number of control signal, if necessary.

Then, how to produce final control signals f0 to f3 depending on the state of the fuse and pad signal will be explained by reference to table 1 below.

TABLE 1

| | pad0 | pad1 | pad2 | fs1 | fs2 | f0 | f1 | f2 | f3 |
|---|---|---|---|---|---|---|---|---|---|
| 1 | 0 | d | d | 0 | 0 | 0 | 0 | 0 | 1 |
| 2 | 0 | d | d | 1 | 0 | 0 | 0 | 1 | 0 |
| 3 | 0 | d | d | 0 | 1 | 0 | 1 | 0 | 0 |
| 4 | 0 | d | d | 1 | 1 | 1 | 0 | 0 | 0 |
| 5 | 1 | 0 | 0 | d | d | 0 | 0 | 0 | 1 |
| 6 | 1 | 1 | 0 | d | d | 0 | 0 | 1 | 0 |
| 7 | 1 | 0 | 1 | d | d | 0 | 1 | 0 | 0 |
| 8 | 1 | 1 | 1 | d | d | 1 | 0 | 0 | 0 |

In the table 1, at pad0 to pad2, "0" means a logic low and "1" means a logic high. At fs1 and fs2, "0" means a fuse blowing, "1" the state in which the fuse blowing is not performed and "d" "neglect(don't care)" state.

From the table 1, it can be seen that depending on the signal state of the pad, the fuse of two bits or the pad detection state may produce final output signals corresponding to each other.

That is, in case of 1 to 4 in the table 1, as the signal of the pad pad0 is at a logic low, the states of the control signals f0 to f3 can be decided by the fuse signal program. On the other hand, in case of 5 to 8, as the signal of the pad pad0 is at a logic high, the states of the control signals f0 to f3 can be decided by the pad signal program before the fuse blowing.

As described above, according to the present invention, as the variable controller is used to perform a potential regulating test on the reference voltage, the advantages by which a stable voltage corresponding changes in the internal supply voltage can be obtained before the fuse blowing, a fuse blowing for regulating the potential of the reference voltage can be realized using the measured result, and the regulating test on the level of the internal supply voltage can be exactly performed as well as reduction of test time.

While the present invention has been described and illustrated herein with reference to the preferred embodiment thereof, it will be understood by those skilled in the art that various changes in form and details may be made therein without departing from the spirit and scope of the invention.

What is claimed is:

1. An internal voltage fall-down circuit comprising:

a reference voltage generating means for variably generating an optimum reference voltage level which is compensated for depending on chances in the present reference voltage before fuse blowing;

a reference voltage transforming means for receiving said reference voltage from said reference voltage generating means and then transforming said reference voltage into voltage for a normal mode or a stress mode which are presently set; and a driver means for providing the signal from said reference voltage transforming means to an internal circuit as an internal supply voltage;

wherein said reference voltage generating means includes:

a reference voltage generator for generating a first constant reference voltage, a comparator for comparing a final preset reference voltage feedbackedly received with said first reference voltage from said reference voltage generator, a current driver for providing a given final reference voltage to said reference voltage transforming means in response to an output of said comparator, a voltage regulator for variably regulating the final reference voltage and outputting a regulated voltage to said comparator, and a variable controller comprising a fuse detecting section for detecting fuse signals; a pad signal detecting section for detecting pad signals; a selecting section for selecting any one of said fuse signal detecting section and said pad signal detecting section by detecting said pad signal; and a control signal output section for combining the signals from said fuse signal detecting section and said pad signal detecting section to output control signals for said voltage regulator.

2. The circuit as claimed in claim 1, wherein said voltage regulator includes a fixed resistor element and a variable resistor element which are serially connected between said current driver and the ground to each other.

3. The circuit as claimed in claim 2, wherein said variable resistor includes a plurality of MOS transistors connected to one end of said fixed resistor, each of which is switched by the control signal from said variable controller; and a plurality of MOS transistors connected between said plurality of MOS transistors and the ground, each of which is switched by the level of the final reference voltage which will be feedbacked to said comparator and the channel sizes of which are differential among another.

4. The circuit as claimed in claim 1, wherein said fuse signal detecting section includes first and second fuse signal detecting sections, said first and second fuse signal detecting sections including a fuse connected to the power supply; a MOS capacitor and a NMOS transistor both connected between said fuse and the ground, for maintaining a given level of signal depending on whether the fuse is blown or not; and inverters serially connected to the node between the fuse and the MOS capacitor, for processing the signal of the node to output a fuse signal.

5. The circuit as claimed in claim 1, wherein said pad signal detecting section includes first and second pad signal detecting sections, said first and second pad signal detecting sections each including a MOS capacitor and a NMOS transistor both connected between a pad and a ground, for maintaining a given level of signal depending on whether the supply voltage is applied to the pad or not; and inverters both serially connected to a node between the pad and the MOS capacitor, for processing the signal of the node to output a pad signal.

6. The circuit as claimed in claim 1, wherein said select section includes a MOS capacitor and a NMOS transistor both connected between the pad and the ground, for maintaining a given level of signal depending on whether the supply voltage is applied to the pad or not; and inverters both serially connected to the node between the pad and the MOS capacitor, for processing the signal of the node to output a select signal.

7. The circuit as claimed in claim 1, wherein said control signal output section includes first and second control signal output sections, said first and second control signal output sections each including a first NOR gate for NORing a select signal from the selecting section, the detection signal from the first pad signal detecting section and the detection signal from the second pad signal detecting section using them as inputs; a second NOR gate for NORing the detection signal from the selecting section, the detection signal from the first fuse signal detecting section and the detection signal from the second fuse signal detecting section using them as inputs; a third NOR gate for NORing the output signals from the NOR gates using them as inputs, and an inverter for inverting the output signal from the third NOR gate to output a control signal.

8. An internal voltage fall-down circuit comprising:

a reference voltage generating circuit for variably generating an optimum reference voltage level which is compensated for, depending on changes in the present reference voltage before fuse blowing;

a reference voltage transforming circuit for receiving said reference voltage from said reference voltage generating circuit and then transforming said reference voltage into voltage for a normal mode or a stress mode which are presently set; and a driver circuit for providing the signal from said reference voltage transforming circuit to an internal circuit as an internal supply voltage; wherein said reference voltage generating circuit includes:

a reference voltage generator for generating a first constant reference voltage, a comparator for comparing a final preset reference voltage feedbackedly received with said first reference voltage from said reference voltage generator, a current driver for providing a given final reference voltage to said reference voltage transforming circuit in response to an output of said comparator, a voltage regulator for variably regulating the final reference voltage and outputting a regulated voltage to said comparator, and a variable controller comprising:

a fuse detecting section for detecting fuse signals;

a pad signal detecting section for detecting pad signals;

a selecting section for selecting any one of said fuse signal detecting section and said pad signal detecting section by detecting said pad signal; and a control signal output section for combining the signals from said fuse signal detecting section and said pad signal detecting section to output control signals for said voltage regulator.

9. The circuit as claimed in claim 8, wherein said fuse signal detecting section includes first and second fuse signal detecting sections, said first and second fuse signal detecting sections including a fuse connected to the power supply; a MOS capacitor and an NMOS transistor both connected between said fuse and the ground, for maintaining a given level of signal depending on whether the fuse is blown or not; and inverters serially connected to a node between the fuse and the MOS capacitor, for processing the signal of the node to output a fuse signal.

10. An internal voltage fall-down circuit comprising:

a reference voltage generating circuit for variably generating an optimum reference voltage level which is compensated for, depending on changes in the present reference voltage before fuse blowing;

a reference voltage transforming circuit for receiving said reference voltage from said reference voltage generating circuit and then transforming said reference voltage into voltage for a normal mode or a stress mode which are presently set; and a driver circuit for providing the signal from said reference voltage transforming circuit to an internal circuit as an internal supply voltage;

wherein said reference voltage generating circuit includes a variable controller comprising:

a fuse detecting section for detecting fuse signals;

a pad signal detecting section for detecting pad signals;

a selecting section for selecting any one of said fuse signal detecting section and said pad signal detecting section by detecting said pad signal; and a control signal output section for combining the signals from said fuse signal detecting section and said pad signal detecting section to output control signals for said voltage regulator.

11. The circuit as claimed in claim 10, wherein said fuse signal detecting section includes first and second fuse signal detecting sections, said first and second fuse signal detecting sections including a fuse connected to the power supply; a MOS capacitor and an NMOS transistor both connected between said fuse and the ground, for maintaining a given level of signal depending on whether the fuse is blown or not; and inverters serially connected to a node between the fuse and the MOS capacitor, for processing the signal of the node to output a fuse signal.

* * * * *